United States Patent [19]

Roberts et al.

[11] 4,349,239

[45] Sep. 14, 1982

[54] LOW MATING FORCE CONNECTOR FOR CONNECTING GROUPS OF WIRES

[75] Inventors: Lincoln E. Roberts, Dunedin; Henry G. Wasserlein, Jr., Seminole, both of Fla.

[73] Assignee: AMP Incorporated, Harrisburg, Pa.

[21] Appl. No.: 165,528

[22] Filed: Jul. 3, 1980

[51] Int. Cl.[3] ..... H01R 4/24

[52] U.S. Cl. ..... 339/97 R; 339/49 R

[58] Field of Search ..... 339/47 R–49 B, 339/75 M, 97 R

[56] References Cited

U.S. PATENT DOCUMENTS

| | | | |
|---|---|---|---|
| 3,145,067 | 8/1964 | Mishelevich et al. | 339/75 |
| 3,239,796 | 3/1966 | Buchanan et al. | 339/97 |
| 3,315,212 | 4/1967 | Peterson | 339/75 M |
| 3,489,986 | 1/1970 | Frederick | 339/49 R |
| 3,708,779 | 1/1973 | Enright et al. | 339/99 R |
| 3,915,538 | 10/1975 | Gruhn et al. | 339/75 M |
| 4,127,312 | 7/1979 | Fleischhacker et al. | 339/99 R |

*Primary Examiner*—Eugene F. Desmond

*Attorney, Agent, or Firm*—F. Brice Faller

[57] ABSTRACT

Multi-contact electrical connector comprises a rectangular housing having a wire-receiving face and an oppositely directed mating face and contact terminals mounted therein. Housing has aligning means thereon which guide the mating face normally against the mating face of a complementary connector then parallel thereto. Terminals have wire-receiving portions extending from the wire-receiving face and mating portions extending from the mating face which mate laterally with mating portions of complementary terminals during parallel movement of mating faces. Leverage means are provided on the housings so that little force is required to engage or disengage the connectors. Connector and complementary connector may be identical and the preferred terminals are identical and hermaphroditic.

4 Claims, 8 Drawing Figures

LOW MATING FORCE CONNECTOR FOR CONNECTING GROUPS OF WIRES

BACKGROUND OF THE INVENTION

This invention relates to a connector having terminals therein which is disengageably mateable to a complementary connector, and particularly to identical mateable connectors with identical terminals therein. The invention will find extensive use in the communications industry.

Splicing of wires in one cable to those in another cable is a common operation in the telephone industry. Originally, the operation was carried out by means of crimpable electrical connecting devices which served to connect the individual wires. More recently, splicing operations were carried out by modular multi-contact connectors of the type shown in U.S. Pat. Nos. 3,772,635; 3,708,779; 3,239,796; and 3,611,522. These generally comprise a module with terminals therein having wire receiving slots at both of their ends. Pluggability of these terminals is limited at best.

The feature of unlimited pluggability of connector modules is presented in U.S. Pat. No. 4,127,312, which discloses stackable modules with terminals therein having a wire receiving end and a mating end which engages the wire receiving end of terminals in a complementary connector. While presenting major improvements over the previously used connectors, considerable force is required to engage and disengage such connectors where large numbers of terminals are involved.

SUMMARY OF THE INVENTION

The instant invention is directed to a multi-contact connector which is mateable to a complementary connector with minimum force. Connector housings employ aligning means which guide connectors into a partially mated stage where the housings and terminals therein are slightly offset. The connectors are then fully mated by the application of a simple lever to protrusions on the housings to slide the housings laterally into aligned relationship. The terminals in the housings mate laterally during this sliding operation as the aligning means on the housings engage. The connectors may be disengaged by opposite application of the lever. Wires may thus be terminated to the connectors by use of tooling in a shop, and predetermined lengths of cable may then be mated to similarly terminated cables in the field without the use of complex or heavy tooling.

It is thus an object of the invention to provide a multi-contact connector which may be engaged and disengaged to a complementary connector by application of a minimum of force through the use of a simple lever. A further object is to provide a multi-contact connector which may be mated to a complementary connector in only one orientation. Another object is to provide mateable multi-contact connectors which are identical. It is a related object to provide identical, hermaphroditic, and laterally mateable terminals and housings for the connectors.

These and other objects of the invention are achieved in the preferred embodiment, which is described in detail below and illustrated in the accompanying drawings.

DETAILED DESCRIPTION OF THE PREFERRED EMBODIMENT

Figure 1:
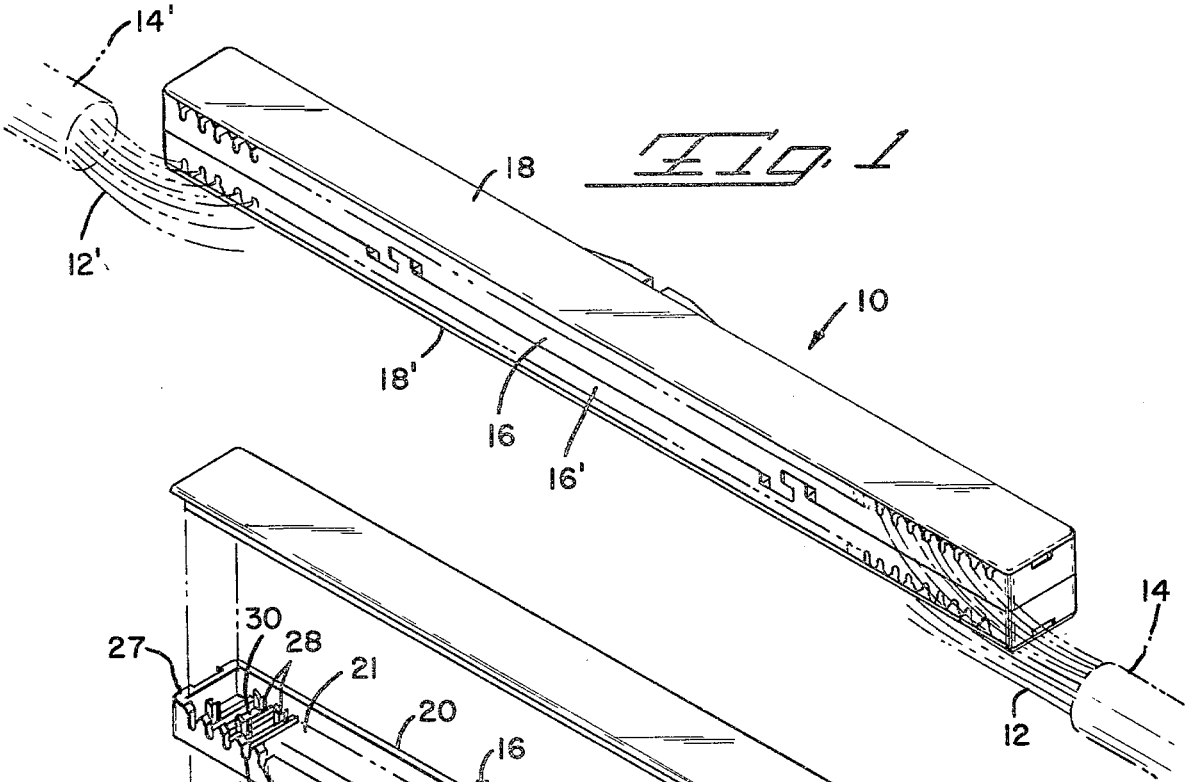
FIG. 1 is a perspective of a connector assembly and cables.

The connector assembly 10 shown in FIG. 1 is used to connect the individual wires 12 of cable 14 to the individual wires 12′ of cable 14′. Wires 12 are terminated to connector 16 which is mated to complementary connector 16′ having wires 12′ terminated thereto. Covers 18 and 18′ are affixed to connectors 16, 16′ to protect the terminations. As the connectors 16, 16′ of the preferred embodiment are identical, prime notations for numerals will be deleted hereinafter except where necessary to show cooperation between the connectors 16, 16′.

Figure 2:
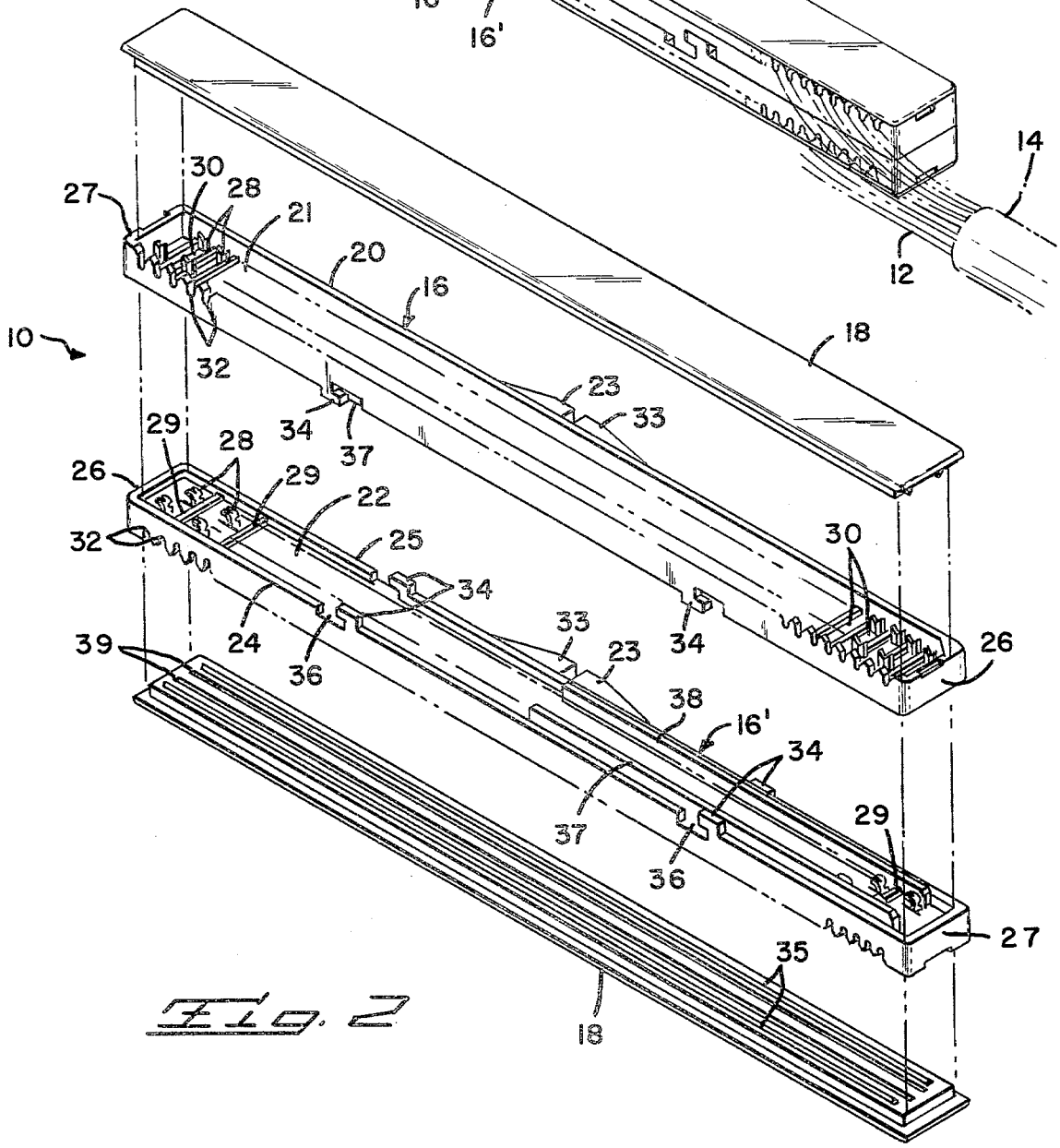
FIG. 2 is a perspective of an exploded connector assembly without cables.

Referring to FIG. 2, the connector 16 comprises a dielectric housing 20 molded in a suitable thermoplastic having a wire receiving face 21, a mating face 22, sidewalls 24, 25 and endwalls 26, 27. Fulcrums 23, 33 extend normally of sidewall 25 while notches 32 extend into side wall 24 normal to the wire receiving face. These notches 32 are aligned with terminals 28 mounted in two parallel rows in the housing, the terminals in one row being offset from terminals in the other. Each terminal 28 extends through the housing 20 and protrudes from both the wire receiving face 21 and the mating face 22 of the connector. Pairs of terminals in adjacent rows are separated by ribs 29 on the mating face 22 while each terminal lies in a respective channel 30 on the wire receiving face 21. Each channel 30 is aligned with a notch 32. Pairs of latch arms 34 are integral with each side wall 24, 25 and extend normally of mating face 22. Each latch arm 34 is L-shaped and extends partially over an adjacent recess 36 in the sidewall.

One latch arm on each sidewall 24 is flanked by a barrier wall 37 which lies against sidewall 24 on the inside of the housing 20 and protrudes above the sidewall 24 across from a matching barrier wall flanking sidewall 25.

Figure 3:
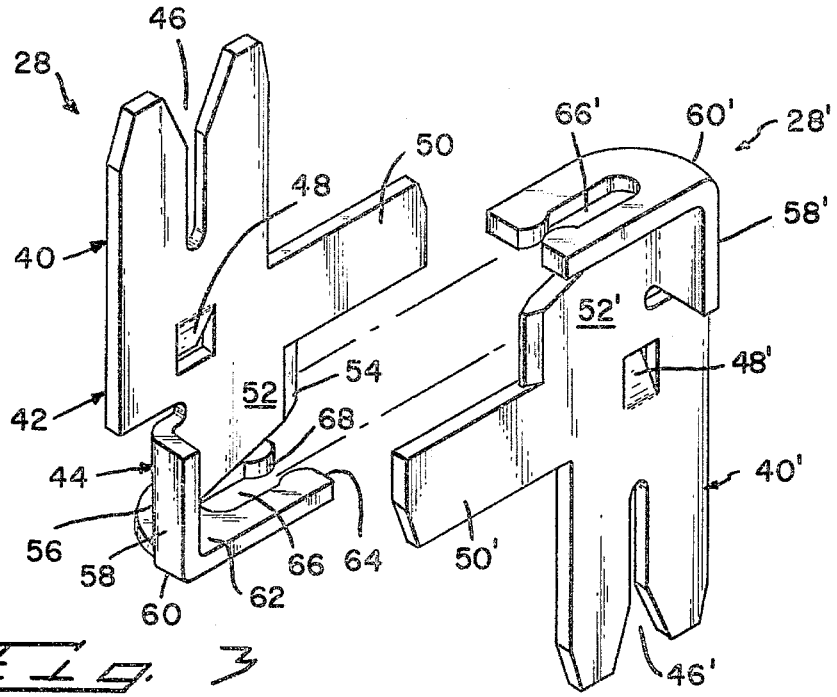
FIG. 3 is a perspective of two hermaphroditic terminals aligned for mating.

The terminals 28 of the preferred embodiment, stamped and formed from metal, are identical in both the connector 16 and complementary connector 16′, and are hermaphroditic in nature. Two such terminals are shown in FIG. 3 positioned for mating. Each terminal has a wire receiving portion 40, an intermediate portion 42, and a mating portion 44. The wire receiving portion 40 has a wire receiving slot 46 extending axially inward as shown. The intermediate portion 42 has a lock tab 48 and a stabilizing bar 50 thereon. The mating portion 44 has a male section 52 in the plane of wire receiving portion 40 and intermediate portion 42. The male section 52 has a mating edge 54 on one side of the axis defined by the wire receiving slot 46 and a right angle bend 56 paralleling the axis on the other side thereof. The bend forms a web 58 in a plane perpendicular to the male section 52. The web has an additional right angle bend 60 perpendicular to the axis which forms female section 62 in a plane perpendicular to the male section 52. The female section 62 has a free end 64 opposite bend 60, the free end having a mating slot 66 therein in the plane of the male section 52. The slot 66 is profiled with opposing nubs 68 which bear on the male section 52' of a complementary identical terminal 28' when the terminals are mated. Each terminal thus has four points of contact with the complementary terminal to which it is mated.

Figure 7:
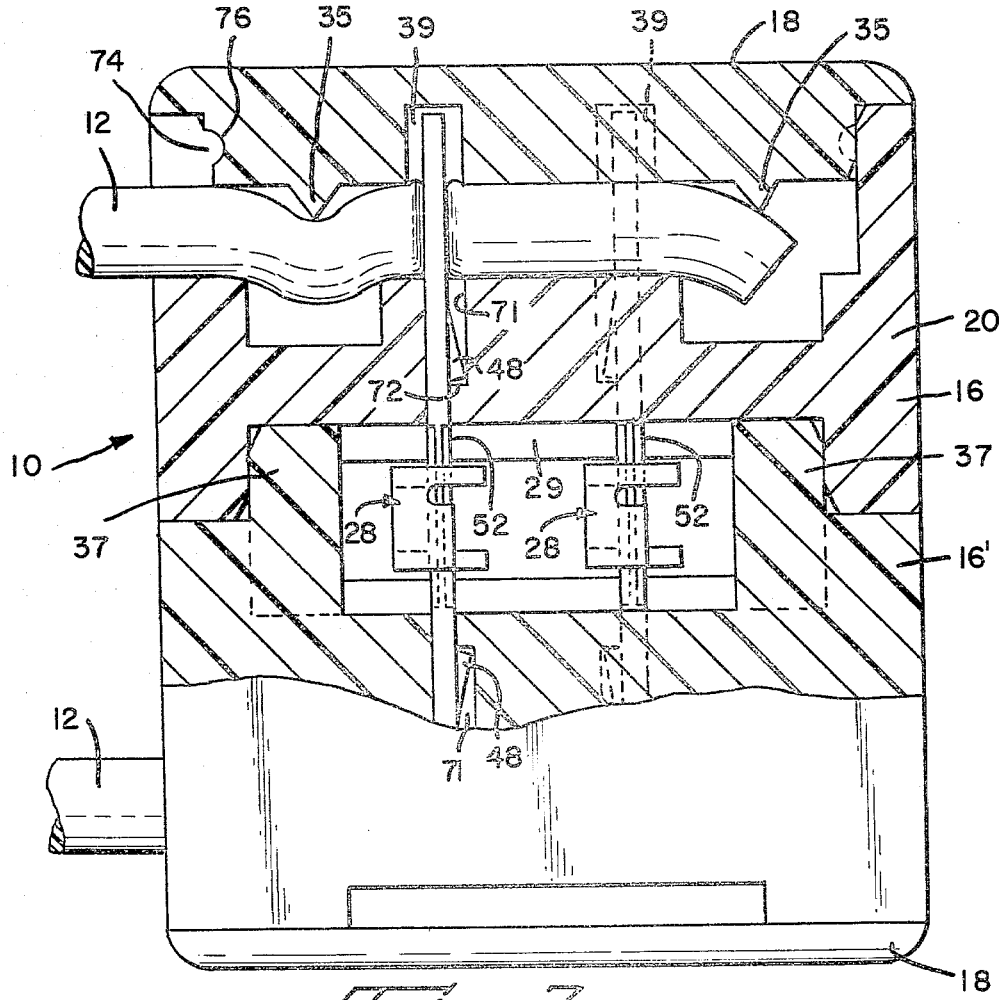
FIG. 7 is a cutaway end view of two connectors as fully assembled.

Terminals 28 are assembled to housing 20 by inserting the wire receiving portion 40 into a closely fitting aperture 71 in the mating face 22 of the terminal until the wire receiving portion 40 protrudes above the wire receiving face 21 and lock tab 48 bears on shoulder 72 as shown cross sectionally in FIG. 7. Stabilizing bar 50 rests on shoulder 73, as shown in FIG. 5, to stabilize the position of the terminal 28 in the housing 20.

Figure 4:
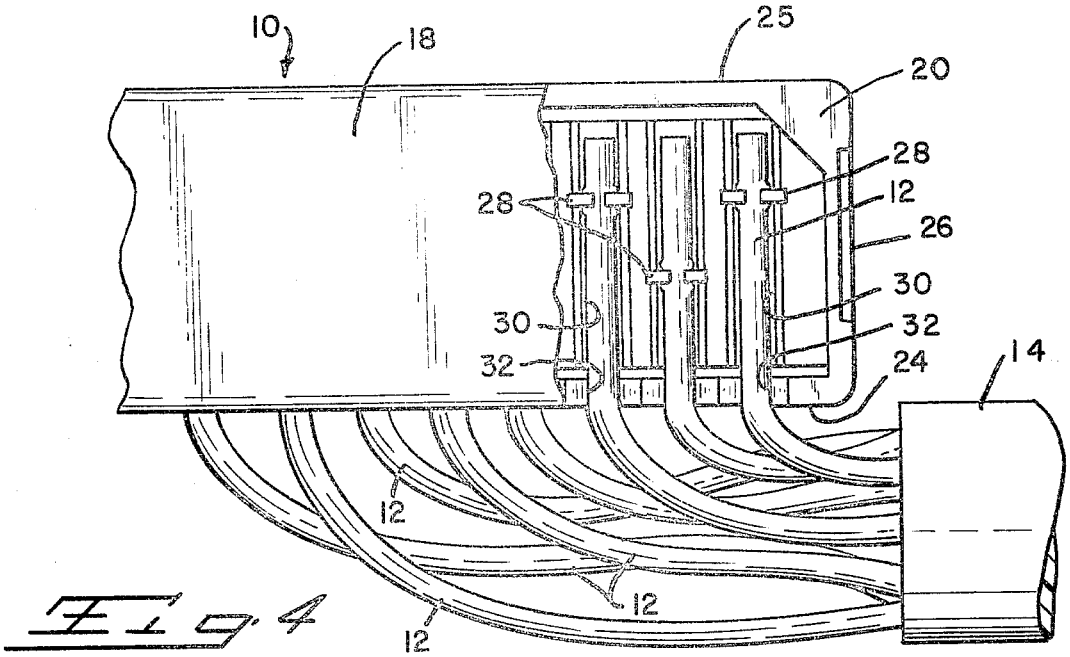
FIG. 4 is a cutaway plan view showing terminated wires of a cable.

After terminals have been snapped into place, wires 12 may be terminated by moving each wire laterally of its axis into a wire receiving slot 46. This action displaces insulation from the wire to effect electrical contact with the conductive core. After all wires have been terminated, cover 18 is pressed into place as shown cross-sectionally in FIG. 7. Ridges 35 bear on the wires adjacent to the terminals while channels 39 receive the tops of the wire receiving portions, thus capturing terminated portions of the wires in the wire receiving slot 46 between the cover 18 and the wire receiving face 21. The cover 18 is locked in place by the cooperation of rib 74 on housing 20 and recess 76 on the edge of the cover. Terminated wires appear in the cutaway view of FIG. 4. Note the each wire 12 enters the sidewall 24 through a notch 32 and lies in a channel 30.

Figure 5:
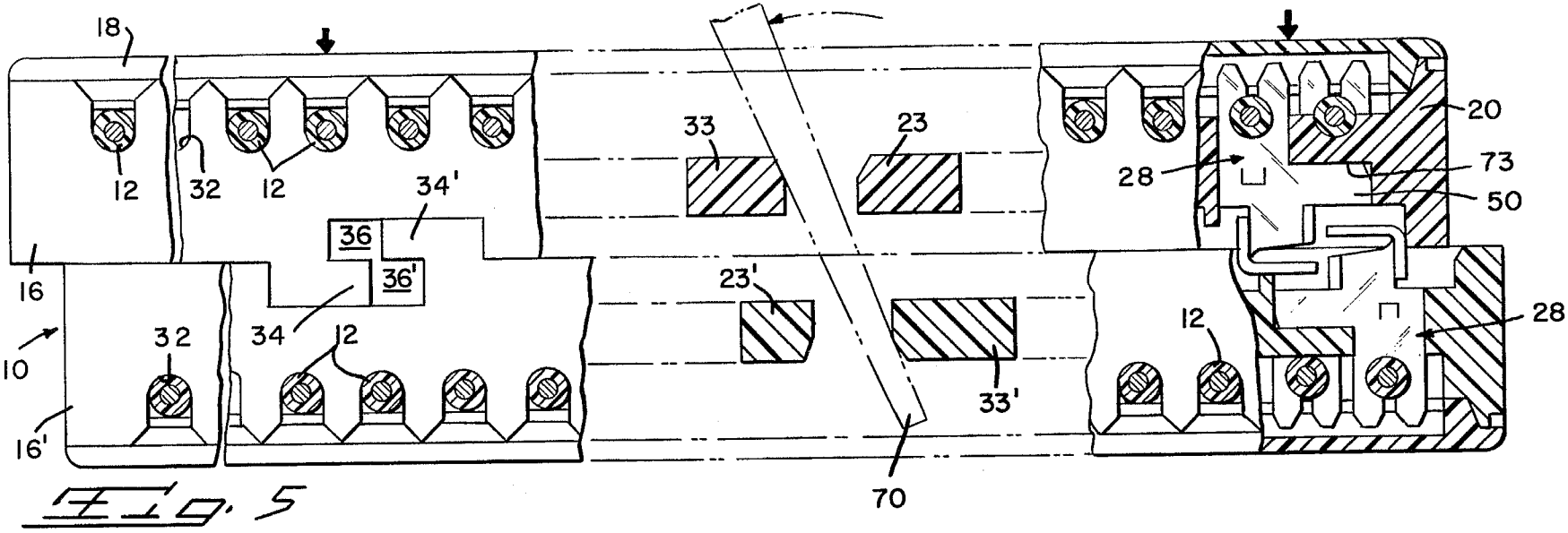
FIG. 5 is a cutaway side view of two connectors in partially assembled condition.

The mating of connector 16 to identical complementary connector 16' is accomplished by moving the mating face 22, 22' together substantially normally their planes to the partially mated position of FIG. 5. Note that latch arm 34 sits in recess 36' while latch arm 34' sits in recess 36. The barrier portions of walls 37, 38 which protrude above sidewalls 24, 25 fit inside sidewalls 24', 25' respectively while walls 37', 38' fit inside sidewalls 24, 25 respectively to align the housings 16, 16'. At this stage of partial assembly each terminal 28 lies adjacent to a terminal 28' with mating portions aligned but offset.

Figure 6:
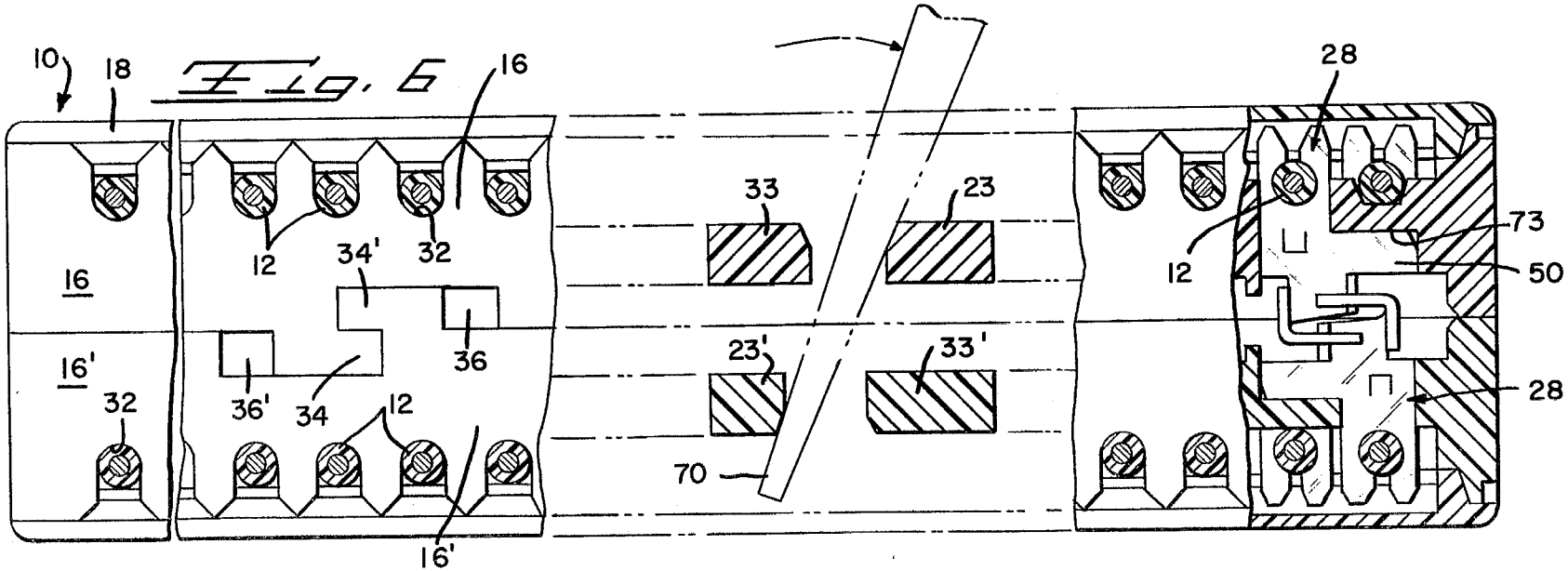
FIG. 6 is a cutaway side view of two connectors in fully assembled condition.

FIG. 6 shows the fully mated position, achieved by movement of connectors 16, 16' parallel to the mating faces so that latch arms 34 ride under latch arms 34'. During this movement the male sections 52 of the terminals 28 ride into the mating slots 66' in the female sections 62' of terminals 28'. The male sections 52' of terminals 28' likewise engage the female sections 62 of the terminals 28. Some resistance is encountered due to the resiliency of the female sections as they expand slightly to engage the male sections, which when multiplied by the number of terminal pairs makes some mechanical advantage desirable. This is achieved by applying a lever 70, which may be a screwdriver, between fulcrums 23, 33 and 23', 33' and turning the lever from the position of FIG. 5 to the position of FIG. 6. The screwdriver bears against fulcrums 23, 23' to the effect the relative movement of the connectors to the fully mated position. This is shown in end cross section in FIG. 7. The connectors may be disengaged by causing the screwdriver to bear against fulcrums 33, 33', which causes lateral disengagement of all of the contact terminals simultaneously. This action prevents the contact distortion which is possible where vertically engaging terminals are disengaged sequentially by prying apart connectors at one end of the assembly.

Figure 8:
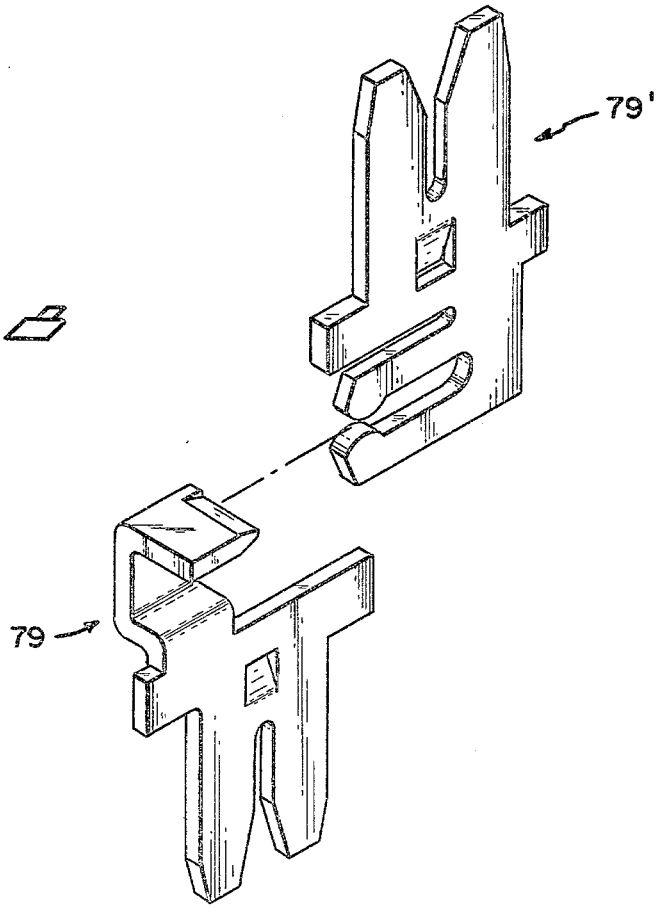
FIG. 8 is a perspective of an alternative type of mating terminals.

While the foregoing has described one embodiment of the invention, others within the scope of the invention should be apparent to those skilled in the art. For example, one of the connectors could be manufactured as a tap connector by providing notches for wire passage on in both sidewalls of the connector. An alternative terminal 79 and non-hermaphroditic, non-identical mating terminal 79' are shown in FIG. 8.

What is claimed is:

1. A multi-contact electrical connector of the type comprising a generally rectangular dielectric housing having a wire receiving face and an opposed mating face and laterally opposed sidewalls and endwalls bounding said faces, a plurality of stamped and formed contact terminals mounted in and extending through said housing, each of said terminals having a wire receiving portion on said wire receiving face and a mating portion on said mating face, said connector being mateable with a complementary connector comprising a complementary housing by mating said mating face of said housing against a complementary mating face of said complementary housing, characterized in that the housing of said connector is identical to the housing of said complementary connector, each said housing having aligning means comprising an L-shaped latch arm integral with each said side wall and extending normally of said mating face, each said latch arm extending partially over an adjacent recess in said sidewall, said latch arms being positioned to fit into a recess in the complementary housing when said mating faces are guided toward each other substantially normally of the planes of said mating faces to a partially mated position in which said housing and said complementary housing are against, but offset from, each other, said latch arms being thereafter interlocked by guiding said housing and complementary housing by movement of said housings parallel to said mating faces into aligned relationship, said mating portions of said terminals lie adjacent to but offset from mating portions of terminals in said complementary housing when said housings are in said partially mated position, said mating portions of said terminals being engageable with complementary mating portions of terminals in said complementary housing upon relative movement of said housings from said partially mating position to said fully mated position.

2. The connector of claim 1 wherein the terminals in said connector are identical to said terminals in said complementary connector, said terminals being hermaphroditic, said mating portion of each said terminal comprises a male section and a female section, said male section comprising a plate-like member normal to said mating face and parallel to the sides of the housing, said male section having a mating edge facing one end of the housing, said female section comprising a plate-like member normal to the plane of said male member and substantially parallel to said mating face, said female section having a free end facing said one end of said housing, said free end having a mating slot extending inward parallel to the plane of the male section, said mating slot being dimensioned to receive said mating edge of a male section of an identical terminal, whereby, said male section of said terminal engages said female section of said complementary terminal while said male section of said complementary terminal engages said female section of said terminal.

3. A stamped and formed hermaphroditic electrical terminal comprising, a wire receiving portion and an axially opposed mating portion, said wire receiving portion comprising a plate-like member having a wire receiving slot extending axially inward, said mating portion having a male section coplanar with said wire receiving portion and a female section in a plane normal to the plane of the male section and substantially normal to the axis, said male section comprising a plate-like member having a mating edge on one side of the axis of the terminal and substantially parallel thereto, said female section comprising a plate-like member having a free end on said one side of the axis, said free end having a mating slot extending inward parallel to the plane of the male section, said mating slot being dimensioned to receive said mating edge of a male section of an identical terminal, whereby, a wire can be electrically connected to said terminal by moving said wire laterally of its axis and into said wire receiving slot, and said terminal can be disengageably mated to a like terminal by moving said mating edge of each terminal into the mating slot of the other terminal.

4. The terminal of claim 3 wherein said male section has a substantially right angle bend parallel to said axis opposite said mating edge, said bend forming a web, said web having an additional substantially right angle bend perpendicular to said axis, said additional bend being integral with said female section on the opposite side of the axis from said free end.

* * * * *